US010741954B1

(12) United States Patent
Ger et al.

(10) Patent No.: US 10,741,954 B1
(45) Date of Patent: Aug. 11, 2020

(54) MULTI-FORM-FACTOR CONNECTOR

(71) Applicant: Mellanox Technologies, Ltd., Yokneam (IL)

(72) Inventors: Andrey Ger, Shlomi (IL); Yaniv Katzav, Hadera (IL); Tarek Hathoot, Akko (IL); Rony Setter, Kfar Glikson (IL)

(73) Assignee: MELLANOX TECHNOLOGIES, LTD., Yokneam (IL)

( * ) Notice: Subject to any disclaimer, the term of this patent is extended or adjusted under 35 U.S.C. 154(b) by 0 days.

(21) Appl. No.: 16/355,753

(22) Filed: Mar. 17, 2019

(51) Int. Cl.
*H01R 13/35* (2006.01)
*H01R 12/73* (2011.01)
*H01R 12/72* (2011.01)

(52) U.S. Cl.
CPC ..... *H01R 13/35* (2013.01); *H01R 12/727* (2013.01); *H01R 12/732* (2013.01)

(58) Field of Classification Search
CPC ..... H01R 13/35; H01R 12/71; H01R 12/727; H01R 12/732
USPC ..... 439/59–62
See application file for complete search history.

(56) References Cited

U.S. PATENT DOCUMENTS 4,367,306 A 1/1983 Maeda et al.
4,869,672 A * 9/1989 Andrews, Jr. ..... H01R 27/00 439/60
4,968,260 A 11/1990 Ingalsbe
4,993,972 A * 2/1991 Lin ..... H01R 27/00 439/633
5,087,207 A 2/1992 Byrne
5,277,591 A * 1/1994 Felcman ..... H01R 12/721 29/831
5,387,110 A 2/1995 Kantner et al.
5,664,950 A 9/1997 Lawrence
5,696,669 A 12/1997 Bassler et al.
5,734,558 A 3/1998 Poplawski et al.
5,766,020 A 6/1998 Hughes
5,788,521 A 8/1998 Milan
5,984,731 A 11/1999 Laity
(Continued)

FOREIGN PATENT DOCUMENTS

CN 205846322 U 12/2016

OTHER PUBLICATIONS

U.S. Appl. No. 16/423,206 office action dated Jan. 7, 2020.
(Continued)

*Primary Examiner* — Oscar C Jimenez
(74) *Attorney, Agent, or Firm* — Kligler & Associates Patent Attorneys Ltd

(57) ABSTRACT

In one embodiment, a female data-connector device includes a housing having a socket to insert therein a first paddle-card having a first form-factor and a second paddle-card having a second form-factor, the socket includes an upper and lower surface, with N contact pins arranged in a first row and M contact pins arranged in a second row on the upper surface, P contact pins arranged in a first row and Q contact pins arranged in a second row on the lower surface, the M and Q and some of the N and P contact pins are arranged to make contact with contact pads of the first paddle-card, the N and P contact pins are arranged to make contact with contact pads of the second paddle-card, N is greater than M, and P is greater than Q, and termination legs to be connected to a printed circuit board.

24 Claims, 3 Drawing Sheets

(56) References Cited

U.S. PATENT DOCUMENTS

| | | | | |
|---|---|---|---|---|
| 6,183,307 | B1 | 2/2001 | Laity et al. | |
| 6,183,308 | B1 | 2/2001 | Laity | |
| 6,203,333 | B1 | 3/2001 | Medina et al. | |
| 6,215,656 | B1 | 4/2001 | O'Neal et al. | |
| 6,256,448 | B1 | 7/2001 | Shahid | |
| 6,517,382 | B2 | 2/2003 | Flickinger et al. | |
| 6,648,695 | B1 | 11/2003 | Wu | |
| 6,773,291 | B1 | 8/2004 | Roth et al. | |
| 6,814,593 | B2 | 11/2004 | Wang et al. | |
| 6,816,376 | B2 | 11/2004 | Bright et al. | |
| 7,028,202 | B2 | 4/2006 | Long et al. | |
| 7,048,550 | B2 | 5/2006 | Hayland et al. | |
| 7,335,033 | B1 | 2/2008 | Edwards, Jr. et al. | |
| 7,380,993 | B2 | 6/2008 | Dallesasse | |
| 7,452,139 | B2 | 11/2008 | Wang et al. | |
| 7,747,292 | B2 | 6/2010 | Mezer et al. | |
| 7,823,041 | B2 | 10/2010 | Mezer et al. | |
| 7,934,959 | B2 | 5/2011 | Rephaeli et al. | |
| 8,075,199 | B2 | 12/2011 | Losio et al. | |
| 8,083,417 | B2 | 12/2011 | Aronson et al. | |
| 8,419,444 | B2 | 4/2013 | Kagan et al. | |
| 8,599,559 | B1 | 12/2013 | Morrison et al. | |
| 8,641,429 | B2 | 2/2014 | Fish et al. | |
| 8,944,704 | B2 | 2/2015 | Lagziel et al. | |
| D734,728 | S | 7/2015 | Lagziel et al. | |
| 9,793,667 | B1 | 10/2017 | Park et al. | |
| 9,887,782 | B2 | 2/2018 | Hosking | |
| 10,122,106 | B2 | 11/2018 | Regnier | |
| 10,128,627 | B1 | 11/2018 | Kazav et al. | |
| 10,276,995 | B2 | 4/2019 | Little | |
| 2001/0019907 | A1 | 9/2001 | Glad et al. | |
| 2004/0013369 | A1 | 1/2004 | Coffey et al. | |
| 2004/0023559 | A1 | 2/2004 | Wu | |
| 2005/0254759 | A1 | 11/2005 | O'Brien | |
| 2007/0232132 | A1 | 10/2007 | Ling et al. | |
| 2007/0237464 | A1 | 10/2007 | Aronson et al. | |
| 2007/0237472 | A1 | 10/2007 | Aronson et al. | |
| 2008/0044141 | A1 | 2/2008 | Willis et al. | |
| 2008/0069052 | A1 | 3/2008 | Mezer et al. | |
| 2008/0150546 | A1 | 6/2008 | Gale | |
| 2008/0249470 | A1 | 10/2008 | Malave et al. | |
| 2008/0267620 | A1 | 10/2008 | Cole et al. | |
| 2009/0060425 | A1 | 3/2009 | Aronson et al. | |
| 2009/0061662 | A1* | 3/2009 | Chin | H01R 27/00 439/83 |
| 2009/0093137 | A1 | 4/2009 | Badehi et al. | |
| 2009/0093166 | A1 | 4/2009 | Fogg et al. | |
| 2009/0232151 | A1 | 9/2009 | Furlong et al. | |
| 2009/0247006 | A1 | 10/2009 | Thompson | |
| 2010/0014566 | A1 | 1/2010 | Mezer et al. | |
| 2011/0123157 | A1 | 5/2011 | Belsan et al. | |
| 2012/0015552 | A1 | 1/2012 | Diab et al. | |
| 2012/0141132 | A1 | 6/2012 | Walker | |
| 2012/0264335 | A1* | 10/2012 | Feyder | H01R 12/732 439/629 |
| 2013/0071072 | A1 | 3/2013 | Xie | |
| 2013/0251052 | A1 | 9/2013 | Tang et al. | |
| 2015/0092363 | A1 | 4/2015 | Blier et al. | |
| 2015/0147062 | A1 | 5/2015 | Otte | |
| 2015/0282382 | A1 | 10/2015 | Nguyen | |
| 2016/0006182 | A1* | 1/2016 | Patel | H01R 13/652 439/108 |
| 2017/0005446 | A1 | 1/2017 | Regnier | |
| 2017/0077643 | A1 | 3/2017 | Zbinden et al. | |
| 2018/0259723 | A1 | 9/2018 | Mentovich et al. | |
| 2019/0044299 | A1 | 2/2019 | Kazav et al. | |

OTHER PUBLICATIONS

"Cisco 40GBASE QSFP+ Modules", Data sheet, pp. 1-7, Oct. 2012.

International Electrotechnical Commission, Standard IEC-61754-7, "Fibre optic interconnecting devices and passive components—Fibre optic connector interfaces—Part 7: Type MPO connector family", Edition 3.0, pp. 1-32, Mar. 2008.

International Electrotechnical Commission, Standard IEC-61754-5, "Fibre optic connector interfaces—Part 5: Type MT connector family", Edition 2.0, pp. 1-32, Jul. 2005.

Mellanox Technologies, "Quad to Serial Small Form Factor Pluggable Adapter: Enabling VPI/40GigE Connectivity on 1/10GigE Infrastructure", 1 page, USA 2010.

SFF Committee, "SFF-8431 Specifications for Enhanced Small Form Factor Pluggable Module SFP+", Revision 4.1, pp. 1-132, Jul. 6, 2009.

SFF Committee, "SFF-8436 Specification for QSFP+ Copper and Optical Modules", Revision 3.4, pp. 1-71, Nov. 12, 2009.

SFF Committee, "INF-8438i Specification for QSFP (Quad Small Formfactor Pluggable) Transceiver", Revision 1.0, pp. 1-75, Nov. 2006.

Barrass et al, "10GBASE-T: 10 Gigabit Ethernet over Twisted-pair Copper", Ethernet Alliance, Version 1.0, Austin, USA, pp. 1-44, Aug. 2007.

Aquantia Corporation, Quad 10GBASE-T Product Brief, Version 1.0, Milpitas, USA, pp. 1-2, Apr. 23, 2009.

IEEE Standard 802.3an-2006, "IEEE Standard for Information technology—Telecommunications and information exchange between systems—Local and metropolitan area networks—Specific requirements; Part 3: Carrier Sense Multiple Access with Collision Detection (CSMA/CD) Access Method and Physical Layer Specifications; Amendment 1: Physical Layer and Management Parameters for 10 Gb/s Operation, Type 10GBASE-T", pp. 1-181, Sep. 1, 2006.

Solarflare Communications, Inc., "Solarflare SFN5122F Dual-Port 10G Ethernet Enterprise Server Adapter", Product Brief, pp. 1-2, year 2011.

Teranetics—PLX Technology, Inc., "Dual-Speed 10GBase-T / 1000 Base-T Ethernet Physical Layer Device", Product Brief, pp. 1-3, year 2010.

SFP-DD MSA, "SFP-DD Hardware Specification for SFP Double Density 2X Pluggable Transceiver", Revision 1.1, pp. 1-49, Jan. 7, 2018.

Cisco, "Cisco QSFP to SFP or SFP+ Adapter Module", pp. 1-3, Jun. 24, 2017.

Mellanox Technologies, "10Gb/s DynamiX QSATM QSFP+ to SFP+ Adapter", pp. 1-3, Feb. 8, 2018.

QSFP-DD MSA, "QSFP-DD Hardware Specification for QSFP Double Density 8X Pluggable Transceiver", Revision 3.0, pp. 1-69, Sep. 19, 2017.

OSFP "Frequently Asked Questions", pp. 1-2, May 15, 2017.

Khamaisee et al., U.S. Appl. No. 16/044,520, filed Jul. 25, 2018.

* cited by examiner

FIG. 3A
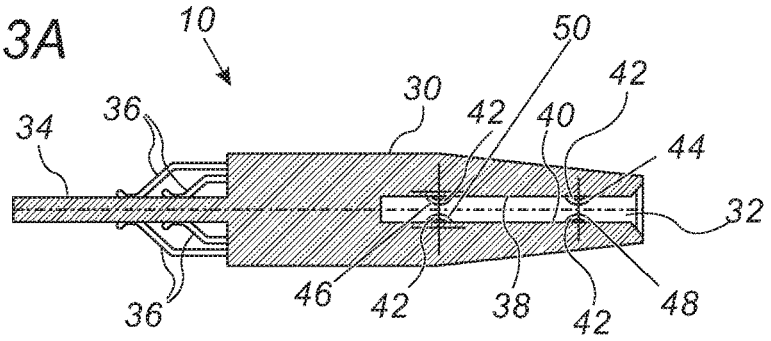
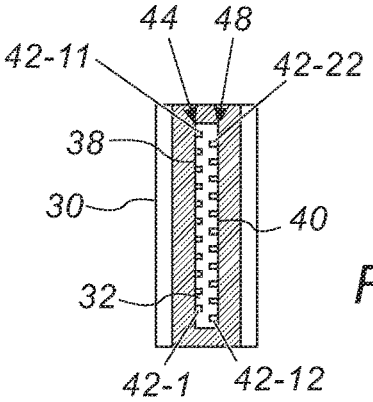
FIG. 3B
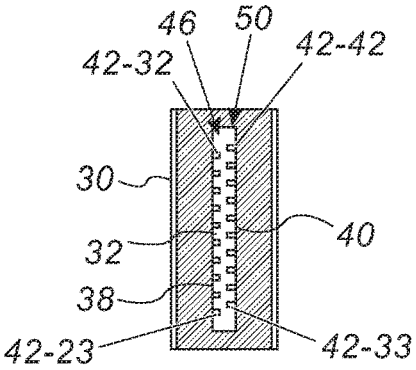
FIG. 3C
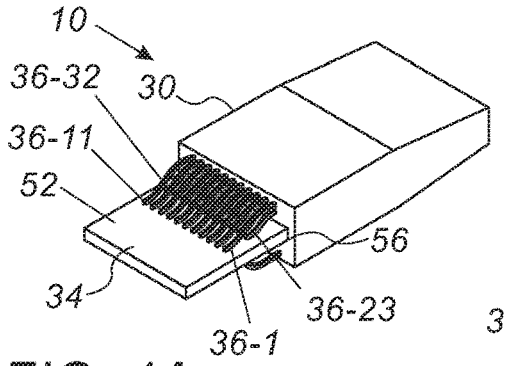
FIG. 4A
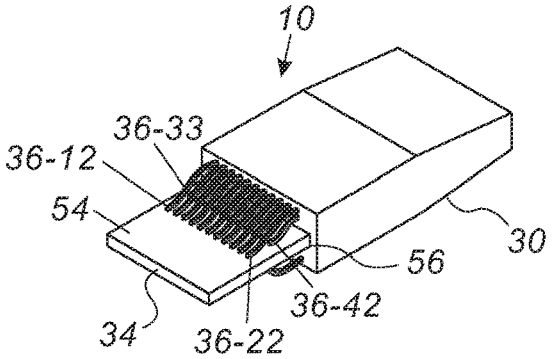
FIG. 4B
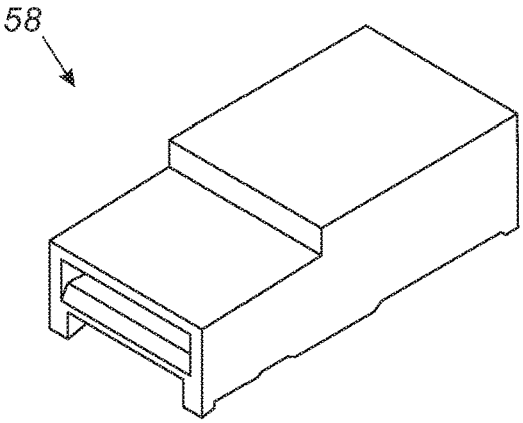
FIG. 5

MULTI-FORM-FACTOR CONNECTOR

FIELD OF THE INVENTION

The present invention relates to data connectors, and in particular, but not exclusively to, multi-form factor data connectors.

BACKGROUND

The small form factor pluggable double-density (SFP-DD) module hardware specification, which is herein incorporated by reference, defines the electrical and optical connectors, electrical signals and power supplies, mechanical and thermal requirements of the SFP-DD module, connector and cage system. SFP-DD supports up to 100 Gb/s in aggregate over a 2×50 Gb/s electrical interface.

The SFP-DD module edge connector consists of a single paddle card with 20 pads (two rows of 10 pads) on the top and 20 pads (two rows of 10 pads) on the bottom of the paddle card for a total of 40 pads. The pad positions are defined to allow insertion of an SFP-DD into the SFP-DD receptacle which includes corresponding contact pins.

The specification for dual SFP (DSFP) module, which is herein incorporated by reference, defines the electrical connectors, electrical signals and power supplies, mechanical and thermal requirements of the DSFP Module, connector and cage systems. The DSFP module is a multi-standard module with each of the electrical lanes supporting data rates from 9.95-53.1 Gb/s.

The DSFP module edge connector consists of a single paddle card with 11 pads on the top and 11 pads on the bottom of the paddle card for a total of 22 pads. The pad positions are defined to allow insertion of a DSFP paddle card into a DSFP receptacle with includes corresponding contact pins.

SUMMARY

There is provided in accordance with an embodiment of the present disclosure, a female data-connector device, including a housing having a socket configured to reversibly insert therein and form an electromechanical connection therewith, at different times, a first paddle-card having a first form-factor and a second paddle-card having a second form-factor, wherein the first form-factor is different from the second form-factor with respect to an arrangement and number of contact pads, the socket includes an upper surface and a lower surface, with N contact pins arranged in a first row on the upper surface, M contact pins arranged in a second row on the upper surface, P contact pins arranged in a first row on the lower surface, and Q contact pins arranged in a second row on the lower surface, the M and Q contact pins and some of the N and P contact pins are arranged to make contact with respective contact pads of the first paddle-card, the N and P contact pins are arranged to make contact with respective contact pads of the second paddle-card, N is greater than M, and P is greater than Q, and a plurality of termination legs electrically connected to the N, M, P and Q contact pins, and configured to be electromechanically connected to a printed circuit board.

Further in accordance with an embodiment of the present disclosure a first outermost contact pin of the N contacts pins, and a second outermost contact pin of the P contact pins are arranged to make contact with only respective ones of the contact pads of the second paddle-card.

Still further in accordance with an embodiment of the present disclosure the first outermost contact pin and the second outermost contact pin are arranged to not make contact with any of the contact pads of the first paddle-card.

Additionally, in accordance with an embodiment of the present disclosure the first row is a front row, and the second row is a back row.

Moreover, in accordance with an embodiment of the present disclosure the first row is a front row, and the second row is a back row.

Further in accordance with an embodiment of the present disclosure the first paddle-card is an SFP-DD form-factor paddle-card, the second paddle-card is a DSFP form-factor paddle-card N equals eleven, P equals eleven, M equals ten, Q equals ten, the contact pins in the back row of the upper and lower surface and ten of the contract pins in the front row of the upper and lower surface are arranged to make contact with the respective contact pads of the SFP-DD form factor paddle-card, and the contact pins in the front row of the upper and lower surfaces are arranged to make contact with the respective contact pads of the DSFP form-factor paddle-card.

Still further in accordance with an embodiment of the present disclosure a first outermost contact pin of the contacts pins in the front row of the upper surface, and a second outermost contact pin of the contact pins in the front row of the lower surface are arranged to make contact with only respective ones of the contact pads of the DSFP form-factor paddle card.

Additionally, in accordance with an embodiment of the present disclosure the termination legs are configured to form a surface mounted electromechanical connection with the printed circuit board with all of the termination legs being connected to one side of the printed circuit board.

Moreover, in accordance with an embodiment of the present disclosure the termination legs are arranged in four rows corresponding with the rows of the contact pins.

Further in accordance with an embodiment of the present disclosure the termination legs include an upper group of termination legs and a lower group of termination legs, the upper group and the lower group being configured to be connected to one side and an opposite side of the printed circuit board, respectively, with the housing abutting an edge of the printed circuit board.

Still further in accordance with an embodiment of the present disclosure the upper group of termination legs is arranged in two rows, and the lower group of termination legs is arranged in two rows.

Additionally, in accordance with an embodiment of the present disclosure the socket has a width in the range of 9.3 to 9.4 mm.

Moreover, in accordance with an embodiment of the present disclosure the contact pins of each of the rows are arranged with a pitch of in the range of 0.7 to 0.9 mm.

Further in accordance with an embodiment of the present disclosure the contact pins of each of the rows are arranged a pitch of about 0.8 mm.

There is also provided in accordance with another embodiment of the present disclosure, a female data-connector device, including a housing having a socket configured to reversibly insert therein and form an electromechanical connection therewith, at different times, a first paddle-card having a first form-factor and a second paddle-card having a second form-factor, wherein the first form-factor is different from the second form-factor with respect to an arrangement and number of contact pads, the socket includes an upper surface and a lower surface, with N contact pins arranged in a first row on the upper surface, M contact pins arranged in a second row on the upper surface, P contact pins arranged in a first row on the lower surface, and Q contact pins arranged in a second row on the lower surface, at least some of the N, M, P and Q contact pins are arranged to make contact with respective contact pads of the first paddle-card, the N and P contact pins are arranged to make contact with respective contact pads of the second paddle-card, N, M, P, and Q are each greater than 10, a plurality of termination legs electrically connected to the N, M, P and Q contact pins, and configured to be electromechanically connected to a printed circuit board.

Still further in accordance with an embodiment of the present disclosure a first outermost contact pin of the N contacts pins, and a second outermost contact pin of the P contact pins are arranged to make contact with only respective ones of the contact pads of the second paddle-card.

Additionally, in accordance with an embodiment of the present disclosure the first outermost contact pin and the second outermost contact pin are arranged to not make contact with any of the contact pads of the first paddle-card.

Moreover, in accordance with an embodiment of the present disclosure the first row is a front row, and the second row is a back row.

Further in accordance with an embodiment of the present disclosure the first row is a front row, and the second row is a back row.

Still further in accordance with an embodiment of the present disclosure the first paddle-card is an SFP-DD form-factor paddle-card, the second paddle-card is a DSFP form-factor paddle-card ten of the contact pins in the back row of the upper and lower surface and ten of the contract pins in the front row of the upper and lower surface are arranged to make contact with the respective contact pads of the SFP-DD form factor paddle-card, and eleven of the contact pins in the front row of the upper and lower surfaces are arranged to make contact with the respective contact pads of the DSFP form-factor paddle-card.

Additionally, in accordance with an embodiment of the present disclosure a first outermost contact pin of the contacts pins in the front row of the upper surface, and a second outermost contact pin of the contact pins in the front row of the lower surface are arranged to make contact with only respective ones of the contact pads of the DSFP form-factor paddle card.

Moreover, in accordance with an embodiment of the present disclosure the termination legs are configured to form a surface mounted electromechanical connection with the printed circuit board with all of the termination legs being connected to one side of the printed circuit board.

Further in accordance with an embodiment of the present disclosure the termination legs are arranged in four rows corresponding with the rows of the contact pins.

Still further in accordance with an embodiment of the present disclosure the termination legs include an upper group of termination legs and a lower group of termination legs, the upper group and the lower group being configured to be connected to one side and an opposite side of the printed circuit board, respectively, with the housing abutting an edge of the printed circuit board.

Additionally, in accordance with an embodiment of the present disclosure the upper group of termination legs is arranged in two rows, and the lower group of termination legs is arranged in two rows.

Moreover, in accordance with an embodiment of the present disclosure the socket has a width in the range of 9.3 to 9.4 mm.

Further in accordance with an embodiment of the present disclosure the contact pins of each of the rows are arranged with a pitch of in the range of 0.7 to 0.9 mm.

Still further in accordance with an embodiment of the present disclosure the contact pins of each of the rows are arranged a pitch of about 0.8 mm.

BRIEF DESCRIPTION OF THE DRAWINGS

The present invention will be understood from the following detailed description, taken in conjunction with the drawings in which:

FIG. 3A is a cross-sectional view of the female data connector device of FIG. 2 along line A-A;

FIG. 3B is a cross-sectional view of the female data connector device of FIG. 2 along line B-B;

FIG. 3C is a cross-sectional view of the female data connector device of FIG. 2 along line C-C;

FIG. 4A is an orthogonal view showing the top of the female data connector device FIG. 1 illustrating connection of upper termination legs to the printed circuit board;

FIG. 4B is an orthogonal view showing the bottom of the female data connector device FIG. 1 illustrating connection of lower termination legs to the printed circuit board;

FIG. 5 is an orthogonal view of a female data connector device constructed and operative in accordance with an alternative embodiment of the present invention;

DESCRIPTION OF EXAMPLE EMBODIMENTS

Overview

Figure 1:
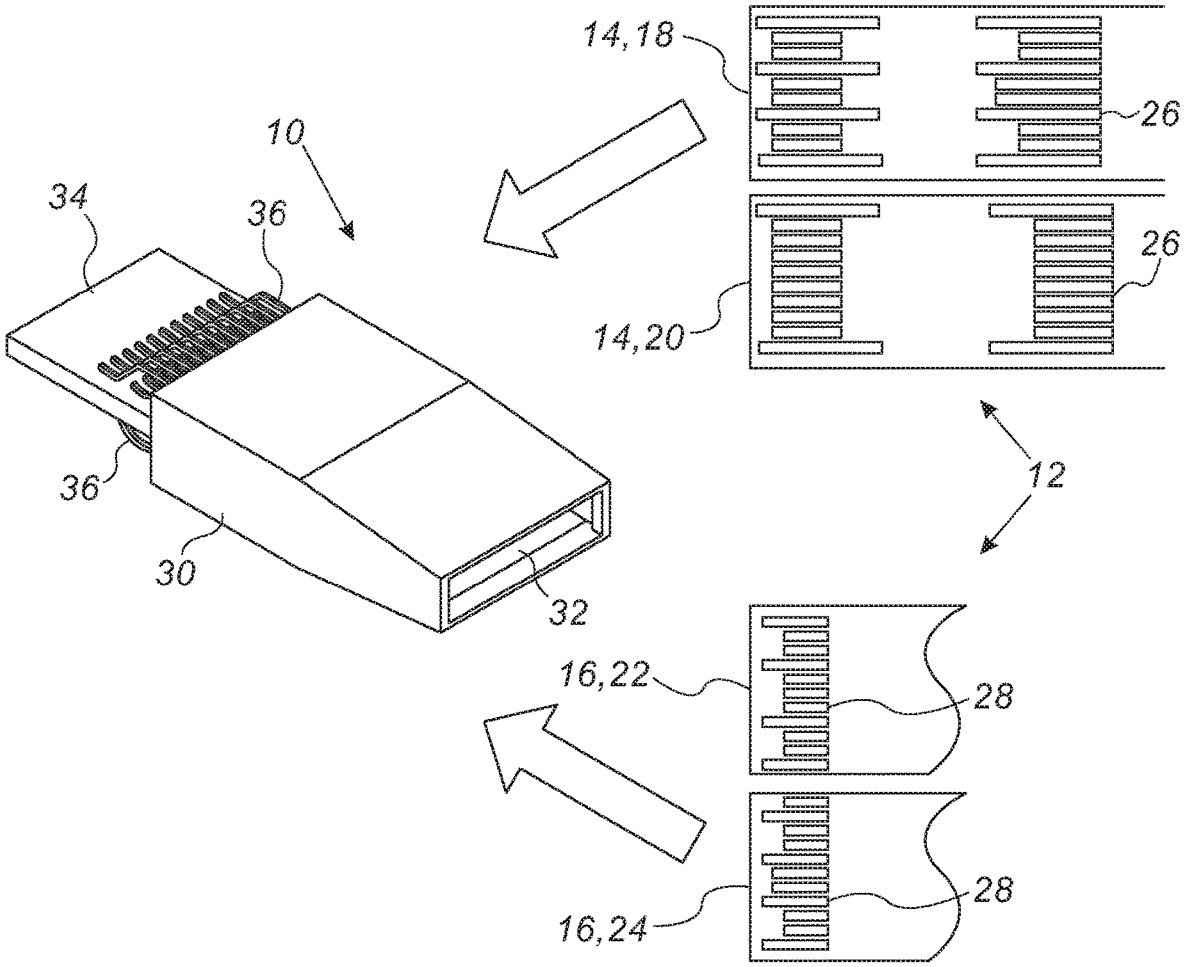
FIG. 1 is an orthogonal view of a female data connector device connected to a printed circuit board and two different types of paddle-cards for inserting therein constructed and operative in accordance with an embodiment of the present invention.

As mentioned above, DSFP connectors are designed to receive DSFP paddle cards while SFP-DD connectors are designed to receive SFP-DD paddle cards. Both connectors provide high bandwidth advantages but the lack of compatibility between the two standards may be problematic when deciding which connector to attach to a printed circuit board (PCB) as attaching one will exclude use of the other. One option is to connect both connectors, thereby providing future connection flexibility. However, adding both types of connectors may complicate PCB design and production, as well as creating confusion during installation and maintenance of network devices as the connectors may look very similar at first glance.

Embodiments of the present invention include a female data-connector device configured to receive at least two different types of paddle cards, for example, by not limited to, SFP-DD paddle cards and DSFP paddle cards as well as SFP and SFP+ paddle cards. The connector receptable thereby reduces design and production costs, allows for a simplified and durable PCB design, and reduces confusion during installation and maintenance of network devices.

The female data-connector device includes a housing having a socket for reversibly inserting therein, and forming an electromechanical connection therewith, at different times, a first paddle-card (e.g., an SFP-DD paddle card) having a first form-factor and a second paddle-card (e.g., a DSPP paddle card) having a second form-factor. The first form-factor is different from the second form-factor with respect to an arrangement and number of contact pads.

The socket includes an upper surface and a lower surface, with N contact pins arranged in a first row (e.g., front row) on the upper surface, M contact pins arranged in a second row (e.g., back row) on the upper surface, P contact pins arranged in a first row (e.g., front row) on the lower surface, and Q contact pins arranged in a second row (e.g., back row) on the lower surface. N is generally greater than M, and P is generally greater than Q. In other words, the first row (e.g., front row) on the upper and lower surface include more contact pins than the second row (e.g., back row) on the upper and lower surface.

The M and Q contact pins and some of the N and P contact pins are arranged to make contact with respective contact pads of the first paddle-card (when inserted) and the N and P contact pins are arranged to make contact with respective contact pads of the second paddle-card (when inserted).

In some embodiments, an outermost contact pin of the N contacts pins, and an outermost contact pin of the P contact pins are arranged to make contact with only respective ones of the contact pads of the second paddle-card and to not make contact with any of the contact pads of the first paddle-card.

When the first paddle-card is an SFP-DD form-factor paddle-card and the second paddle-card is a DSFP form-factor paddle-card, the socket is configured so that N equals eleven, P equals eleven, M equals ten, and Q equals ten. For example, the back rows (on the upper and lower surfaces) each include ten contact pins while the front rows (on the upper and lower surfaces) each include eleven contact pins. The ten contact pins in the back row of the upper and lower surface and only ten of the eleven contract pins in the front row of the upper and lower surface are arranged to make contact with the respective contact pads of the SFP-DD form factor paddle-card, while all eleven contact pins in the front row of the upper and lower surfaces are arranged to make contact with the respective contact pads of the DSFP form-factor paddle-card. An outermost contact pin of the contacts pins in the front row of the upper surface, and an outermost contact pin of the contact pins in the front row of the lower surface are arranged to make contact with only respective ones of the contact pads of the DSFP form-factor paddle card and not make contact with contact pads of the SFP-DD form-factor paddle card. In some embodiments, the socket has a width in the range of 9.0 to 9.5 mm corresponding to the width of the SFP-DD and DSFP paddle cards. In some embodiments. the contact pins of each of the rows are arranged with a pitch of in the range of 0.7 to 0.9 mm, typically about 0.8 mm.

The female data-connector device includes respective termination legs electrically connected to respective ones of the N, M, P and Q contact pins, and configured to be electromechanically connected to a printed circuit board.

In some embodiments, the termination legs are configured to form a surface mounted technology (SMT) electromechanical connection with the PCB with all of the termination legs being connected to one side of the PCB and the termination legs being arranged in four rows corresponding with the four rows of the contact pins.

In other embodiments, the termination legs include an upper group of termination legs and a lower group of termination legs. The upper group and the lower group are configured to be connected to opposite sides of the printed circuit board, respectively, with the housing abutting an edge of the printed circuit board. If the housing is centrally placed with respect to a plane of the printed circuit board, when the paddle card is inserted into the socket, the paddle card may be coplanar with the plane of the printed circuit board. The upper group of termination legs may be arranged in two rows, and the lower group of termination legs may be arranged in two rows.

System Description

Documents incorporated by reference herein are to be considered an integral part of the application except that, to the extent that any terms are defined in these incorporated documents in a manner that conflicts with definitions made explicitly or implicitly in the present specification, only the definitions in the present specification should be considered.

Reference is now made to FIG. 1, which is an orthogonal view of a female data connector device 10 connected to a printed circuit board 34 and two different types of paddle-cards 12 for inserting therein constructed and operative in accordance with an embodiment of the present invention. The female data connector device 10 is a receptacle including a housing 30 having a socket 32 configured to reversibly insert therein and form an electromechanical connection therewith, at different times, different form-factor paddle cards 12, such as a first paddle-card having a first form-factor and a second paddle-card having a second form-factor.

The first form-factor is different from the second form-factor with respect to an arrangement and number of contact pads included in the paddle cards 12 described in more detail below.

The female data connector device 10 is shown in FIG. 1 as being connected to the printed circuit board 34 by a plurality of termination legs 36 (only some are labeled for the sake of simplicity) described in more detail with reference to FIGS. 4A and 4B.

In the example of FIG. 1, the female data connector device 10 is shown as being configured to accept an SFP-DD form-factor paddle card 14 and a DSFP form-factor paddle card 16. FIG. 1 shows a top side 18 of the SFP-DD paddle card 14 and a bottom side 20 (as seen through the top side 18) of the SFP-DD paddle card 14. FIG. 1 also shows a top side 22 of the DSFP paddle card 16 and a bottom side 24 (as seen through the top side 22) of the DSFP paddle card 16. The SFP-DD paddle card 14 includes two rows (a front row and a back row) of 10 contact pads 26 (only some are labeled for the sake of simplicity) on each of the top side 18 and the bottom side 20. The DSFP paddle card 16 includes a single row of 11 contact pads 28 (only some are labeled for the sake of simplicity) on each of the top side 22 and the bottom side 24.

Figure 2:
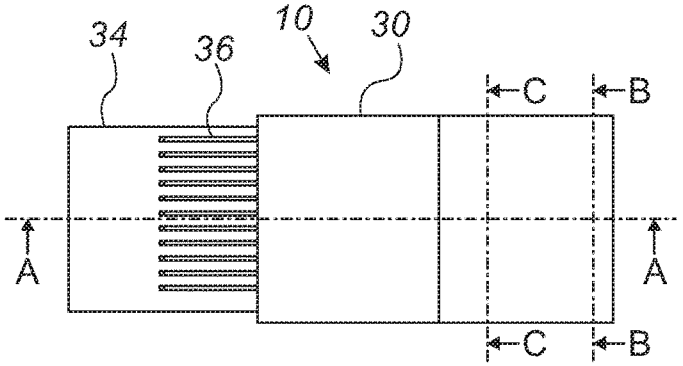
FIG. 2 is a top view of the female data connector device of FIG. 1 connected to the printed circuit board.

Reference is now made to FIGS. 2, 3A-3C which are various views of the female data connector device 10 of FIG. 1. FIG. 2 is a top view of the female data connector device 10 of FIG. 1 connected to the printed circuit board 34. FIG. 3A is a cross-sectional view of the female data connector device 10 of FIG. 2 along line A-A. FIG. 3B is a cross-sectional view of the female data connector device 10 of FIG. 2 along line B-B. FIG. 3C is a cross-sectional view of the female data connector device 10 of FIG. 2 along line C-C.

The socket 32 shown in FIGS. 3A-C is now described in more detail. The socket includes an upper surface 38 and a lower surface 40, with N contact pins 42 arranged in a row 44 (e.g., a front row shown in FIG. 3B) on the upper surface 38, M contact pins 42 arranged in another row 46 (e.g., a back row shown in FIG. 3C) on the upper surface 38, P contact pins 42 arranged in a row 48 (e.g., a front row shown in FIG. 3B) on the lower surface 40, and Q contact pins 42 arranged in a row 50 on the lower surface 40 (e.g., a back row shown in FIG. 3C). The front rows are defined herein as being closer to the opening (which accepts the paddle cards 12 therein) of the socket 32 than the back rows.

The exemplary socket 32 shown in FIGS. 3A to 3C shows forty-two contact pins 42. For the sake of simplicity not all of the contact pins 42 have been labeled. For the sake of clarity some of the contact pins 42 have been labeled in order to indicate the pin number (from 1 to 42). For example, pin 1 has been labeled as 42-1 and pin 32 has been labeled 42-32.

At least some of the M and Q contact pins 42 of rows 46 and 50, respectively, and only some of the N and P contact pins 42, of rows 44 and 48, respectively, are arranged to make contact with respective contact pads of a first paddle-card (e.g., the SFP-DD paddle card 14), while, the N and P contact pins 42 are arranged to make contact with respective contact pads of a second paddle-card (e.g., the DSFP paddle card 16).

In some embodiments, N is greater than M, and P is greater than Q. In other words, there are more pins in the front rows 44, 48 than the back rows 46, 50.

In other embodiments, the number of pins in the front rows 44, 48 may be the same, or less than, the number of pins in the back rows 46, 50.

In some embodiments, N, M, P and Q are each greater than 10. For example, N, M, P and Q may be equal to 11. In some embodiments, N, M, P and Q are each greater than 10, but do not necessarily have the same value.

In some embodiment, an outermost contact pin (e.g., the contact pin 42-11) of the N contacts pins 42 in the front row 44 of the upper surface 38, and another outermost contact pin (e.g., the contact pin 42-12) of the P contact pins 42 in the front row 48 of the lower surface 40 are arranged to make contact with only respective ones of the contact pads of the second paddle-card (e.g., the contact pads 28 (FIG. 1) of the DSFP paddle card 16) and not make contact with any of the contact pads of the first paddle-card (e.g., the contact pads 26 (FIG. 1) of the SFP-DD paddle card 14). The term "only" as used in the specification and claims is defined to limit the abovementioned outermost contact pins as making electro-mechanical contact with contact pads of one paddle-card but not with contract pads of another paddle-card.

FIGS. 3B and 3C show the contact pins 42 arranged to be electromagnetically connected with the SFP-DD paddle card 14 and the DSFP paddle card 16. In this example, N equals eleven, P equals eleven, M equals ten, and Q equals ten. The contact pins 42 in the back row 46 and the back row 50 of the upper surface 38 and the lower surface 40, respectively (e.g., pins 23 to 32, and 33 to 42), and ten of the contact pins 42 in the front row 44 and the front row 48 of the upper surface 38 and the lower surface 40, respectively (e.g., pins 1 to 10, 13 to 22), are arranged to make contact with respective contact pads 26 (FIG. 1) of the SFP-DD paddle card 14. All of the contact pins 42 in the front row 44 and the front row 48 of the upper surface 38 and lower surface 40, respectively (e.g., pins 1 to 11, and 12 to 22) are arranged to make contact with the respective contact pads 28 (FIG. 1) of the DSFP paddle card 16. It should be noted that pins 23 to 32, and 33 to 42 do not electromagnetically connect with the DSFP paddle card 16, and pins 11 and 12 do not electromagnetically connect with the SFP-DD paddle card 14.

The socket 32 may have any suitable width. When the socket 32 is configured to accept the SFP-DD paddle card 14 and the DSFP paddle card 16, the socket 32 has a width in the range of 9.3 to 9.4 mm. The contact pins 42 may be any suitable size and be arranged with any suitable pitch. When the socket 32 is configured to accept the SFP-DD paddle card 14 and the DSFP paddle card 16, the contact pins 42 of each of the rows are arranged with a pitch of in the range of 0.7 to 0.9 mm, and generally with a pitch of about 0.8 mm.

Reference is now made to FIGS. 4A and 4B. FIG. 4A is an orthogonal view showing the top of the female data connector device 10 FIG. 1 illustrating connection of upper termination legs 36 to the printed circuit board 34. FIG. 4B is an orthogonal view showing the bottom of the female data connector device 10 of FIG. 1 illustrating connection of lower termination legs 36 to the printed circuit board 34.

The termination legs 36 are electrically connected to the N, M, P and Q contact pins 42, and are configured to be electromechanically connected to the printed circuit board 34. The exemplary female data connector device 10 shown in FIGS. 4A and 4B shows forty-two termination legs 36. For the sake of simplicity not all of the termination legs 36 have been labeled. For the sake of clarity some of the termination legs 36 have been labeled in order to indicate the leg number (from 1 to 42). For example, leg 1 has been labeled as 36-1 and leg 32 has been labeled 36-32.

The leg numbers associated with the termination legs 36 correspond with the pin numbers associated with the contact pins 42. For example, termination leg 36-1 is electromechanically connected with contact pin 42-1 and so on.

The termination legs 36 include an upper group of termination legs 36 (mainly shown in FIG. 4A) and a lower group of termination legs 36 (mainly shown in FIG. 4B). The upper group and the lower group of the termination legs 36 are configured to be connected to one side 52 and an opposite side 54 of the printed circuit board 34, respectively, with the housing 30 abutting an edge 56 of the printed circuit board 34.

In some embodiments, the upper group of termination legs 36 is arranged in two rows (corresponding to the rows 44, 46 of contact pins 42 of the upper surface 38), and the lower group of termination legs 36 is arranged in two rows (corresponding to the rows, 48, 50, of contact pins 42 of the lower surface 40). In some embodiments, the termination legs 36 may be arranged in a single upper row and a single lower row, or more than two upper rows and more than two lower rows, or any other suitable arrangement.

Reference is now made to FIG. 5, which is an orthogonal view of a female data connector device 58 constructed and operative in accordance with an alternative embodiment of the present invention. The female data connector device 58 is substantially the same as the female data connector device 10 of FIGS. 1-4 except that the connection mode to a printed circuit board differs, as will be described below in more detail with reference to FIGS. 6-9.

Figure 6:
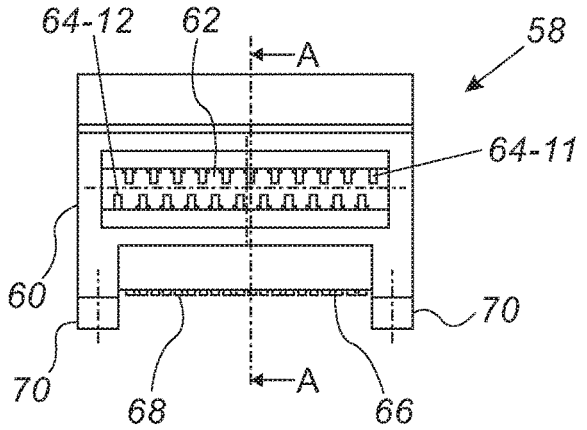
FIG. 6 is an end view of the female data connector device of FIG. 5.
Figure 7:
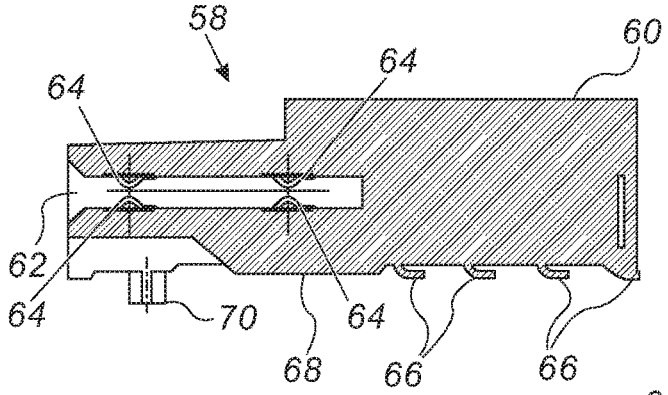
FIG. 7 is a cross-sectional view of the female data connector device of FIG. 6 along line A-A.
Figure 8:
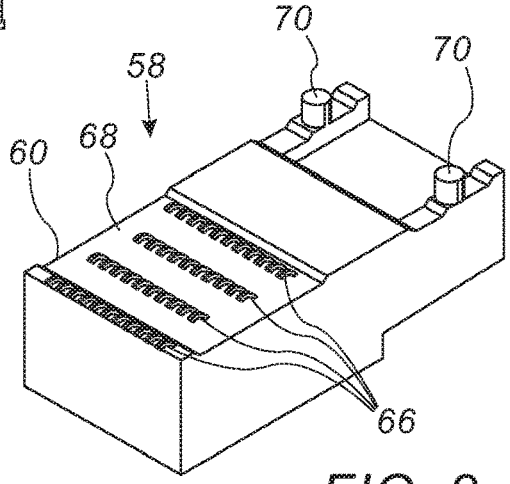
FIG. 8 is an orthogonal view showing the bottom of the female data connector device of FIG. 5.
Figure 9:
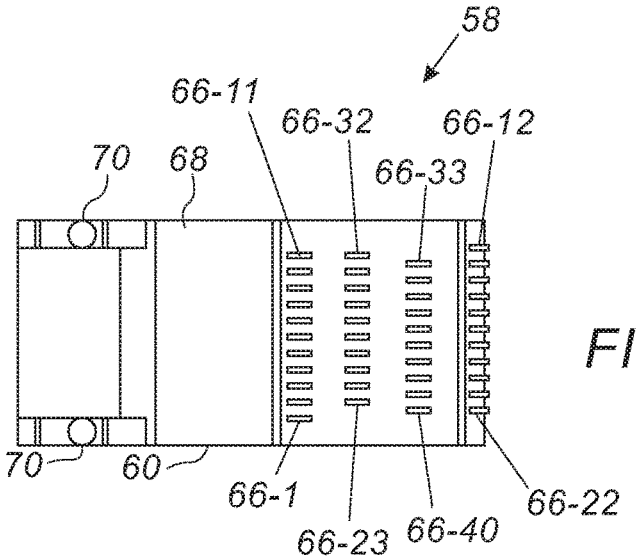
FIG. 9 is a bottom view of the female data connector device of FIG. 5.

Reference is now made to FIGS. 6-9. FIG. 6 is an end view of the female data connector device 58 of FIG. 5. FIG. 7 is a cross-sectional view of the female data connector device 58 of FIG. 6 along line A-A. FIG. 8 is an orthogonal view showing the bottom of the female data connector device 58 of FIG. 5. FIG. 9 is a bottom view of the female data connector device 58 of FIG. 5. The female data connector device 58 includes a housing 60, a socket 62 with a plurality of contact pins 64 therein arranged in rows as described above with reference to the contact pins 42 of the female data connector device 10 of FIGS. 1-4.

The female data connector device 58 also includes a plurality of termination legs 66. The exemplary female data connector device 58 shown in FIGS. 6-9 show forty-two termination legs 66. For the sake of simplicity not all of the termination legs 66 have been labeled. For the sake of clarity some of the termination legs 66 have been labeled in order to indicate the leg number (from 1 to 42). For example, leg 1 has been labeled as 66-1 and leg 32 has been labeled 66-32.

The leg numbers associated with the termination legs 66 correspond with the pin numbers associated with the contact pins 64. For example, termination leg 66-1 is electromechanically connected with contact pin 64-1, and so on.

The termination legs 66 are disposed on a base 68 of the housing 60 in four rows (corresponding with the four rows of the contact pins 64), and are configured to form a surface mounted electromechanical connection with the printed circuit board with all of the termination legs 66 being connected to one side of the printed circuit board. In some embodiments, the termination legs 66 may be disposed in more than four rows or less than four rows.

The female data connector device 58 may also include at least two alignment pins 70 disposed in the base 68 of the housing 60 to align the female data connector device 58 with respect to corresponding alignment holes in the printed circuit board.

Various features of the invention which are, for clarity, described in the contexts of separate embodiments may also be provided in combination in a single embodiment. Conversely, various features of the invention which are, for brevity, described in the context of a single embodiment may also be provided separately or in any suitable sub-combination.

The embodiments described above are cited by way of example, and the present invention is not limited by what has been particularly shown and described hereinabove. Rather the scope of the invention includes both combinations and subcombinations of the various features described hereinabove, as well as variations and modifications thereof which would occur to persons skilled in the art upon reading the foregoing description and which are not disclosed in the prior art.

What is claimed is:

1. A female data-connector device, comprising:

a housing having a socket configured to reversibly insert therein and form an electromechanical connection therewith, at different times, a first paddle-card having a first form-factor and a second paddle-card having a second form-factor, wherein:

the first form-factor is different from the second form-factor with respect to an arrangement and number of contact pads;

the socket includes an upper surface and a lower surface, with N contact pins arranged in a first row on the upper surface, M contact pins arranged in a second row on the upper surface, P contact pins arranged in a first row on the lower surface, and Q contact pins arranged in a second row on the lower surface;

the M and Q contact pins and some of the N and P contact pins are arranged to make contact with respective contact pads of the first paddle-card;

the N and P contact pins are arranged to make contact with respective contact pads of the second paddle-card;

a first outermost contact pin of the N contacts pins, and a second outermost contact pin of the P contact pins are arranged to make contact with only respective ones of the contact pads of the second paddle-card;

N is greater than M; and

P is greater than Q; and a plurality of termination legs electrically connected to the N, M, P and Q contact pins, and configured to be electromechanically connected to a printed circuit board.

2. The device according to claim 1, wherein the first outermost contact pin and the second outermost contact pin are arranged to not make contact with any of the contact pads of the first paddle-card.

3. The device according to claim 1, wherein the first row is a front row, and the second row is a back row.

4. The device according to claim 1, wherein the termination legs are configured to form a surface mounted electromechanical connection with the printed circuit board with all of the termination legs being connected to one side of the printed circuit board.

5. The device according to claim 4, wherein the termination legs are arranged in four rows corresponding with the rows of the contact pins.

6. The device according to claim 1, wherein the termination legs include an upper group of termination legs and a lower group of termination legs, the upper group and the lower group being configured to be connected to one side and an opposite side of the printed circuit board, respectively, with the housing abutting an edge of the printed circuit board.

7. The device according to claim 6, wherein the upper group of termination legs is arranged in two rows, and the lower group of termination legs is arranged in two rows.

8. The device according to claim 1, wherein the socket has a width in the range of 9.3 to 9.4 mm.

9. The device according to claim 1, wherein the contact pins of each of the rows are arranged with a pitch of in the range of 0.7 to 0.9 mm.

10. The device according to claim 1, wherein the contact pins of each of the rows are arranged a pitch of about 0.8 mm.

11. A female data-connector device, comprising:

a housing having a socket configured to reversibly insert therein and form an electromechanical connection therewith, at different times, a first paddle-card having a first form-factor and a second paddle-card having a second form-factor, wherein:

the first form-factor is different from the second form-factor with respect to an arrangement and number of contact pads;

the socket includes an upper surface and a lower surface, with N contact pins arranged in a first row on the upper surface, M contact pins arranged in a second row on the upper surface, P contact pins arranged in a first row on the lower surface, and Q contact pins arranged in a second row on the lower surface;

at least some of the N, M, P and Q contact pins are arranged to make contact with respective contact pads of the first paddle-card;

the N and P contact pins are arranged to make contact with respective contact pads of the second paddle-card;

a first outermost contact pin of the N contacts pins, and a second outermost contact pin of the P contact pins are arranged to make contact with only respective ones of the contact pads of the second paddle-card; and N, M, P, and Q are each greater than 10; and a plurality of termination legs electrically connected to the N, M, P and Q contact pins, and configured to be electromechanically connected to a printed circuit board.

12. The device according to claim 11, wherein the first outermost contact pin and the second outermost contact pin are arranged to not make contact with any of the contact pads of the first paddle-card.

13. The device according to claim 11, wherein the first row is a front row, and the second row is a back row.

14. The device according to claim 11, wherein the termination legs are configured to form a surface mounted electromechanical connection with the printed circuit board with all of the termination legs being connected to one side of the printed circuit board.

15. The device according to claim 14, wherein the termination legs are arranged in four rows corresponding with the rows of the contact pins.

16. The device according to claim 11, wherein the termination legs include an upper group of termination legs and a lower group of termination legs, the upper group and the lower group being configured to be connected to one side and an opposite side of the printed circuit board, respectively, with the housing abutting an edge of the printed circuit board.

17. The device according to claim 16, wherein the upper group of termination legs is arranged in two rows, and the lower group of termination legs is arranged in two rows.

18. The device according to claim 11, wherein the socket has a width in the range of 9.3 to 9.4 mm.

19. The device according to claim 11, wherein the contact pins of each of the rows are arranged with a pitch of in the range of 0.7 to 0.9 mm.

20. The device according to claim 11, wherein the contact pins of each of the rows are arranged a pitch of about 0.8 mm.

21. A female data-connector device, comprising:

a housing having a socket configured to reversibly insert therein and form an electromechanical connection therewith, at different times, a first paddle-card having a first form-factor and a second paddle-card having a second form-factor, wherein:

the first form-factor is different from the second form-factor with respect to an arrangement and number of contact pads;

the first paddle-card is an SFP-DD form-factor paddle-card;

the second paddle-card is a DSFP form-factor paddle-card;

the socket includes an upper surface and a lower surface, with N contact pins arranged in a first row on the upper surface, M contact pins arranged in a second row on the upper surface, P contact pins arranged in a first row on the lower surface, and Q contact pins arranged in a second row on the lower surface;

the first row is a front row, and the second row is a back row;

the M and Q contact pins and some of the N and P contact pins are arranged to make contact with respective contact pads of the first paddle-card;

the N and P contact pins are arranged to make contact with respective contact pads of the second paddle-card;

N equals eleven;

P equals eleven;

M equals ten;

Q equals ten;

the contact pins in the back row of the upper and lower surface and ten of the contract pins in the front row of the upper and lower surface are arranged to make contact with the respective contact pads of the SFP-DD form factor paddle-card; and the contact pins in the front row of the upper and lower surfaces are arranged to make contact with the respective contact pads of the DSFP form-factor paddle-card; and a plurality of termination legs electrically connected to the N, M, P and Q contact pins, and configured to be electromechanically connected to a printed circuit board.

22. The device according to claim 21, wherein a first outermost contact pin of the contacts pins in the front row of the upper surface, and a second outermost contact pin of the contact pins in the front row of the lower surface are arranged to make contact with only respective ones of the contact pads of the DSFP form-factor paddle card.

23. A female data-connector device, comprising:

a housing having a socket configured to reversibly insert therein and form an electromechanical connection therewith, at different times, a first paddle-card having a first form-factor and a second paddle-card having a second form-factor, wherein:

the first form-factor is different from the second form-factor with respect to an arrangement and number of contact pads;

the first paddle-card is an SFP-DD form-factor paddle-card;

the second paddle-card is a DSFP form-factor paddle-card:

the socket includes an upper surface and a lower surface, with N contact pins arranged in a first row on the upper surface, M contact pins arranged in a second row on the upper surface, P contact pins arranged in a first row on the lower surface, and Q contact pins arranged in a second row on the lower surface;

the first row is a front row, and the second row is a back row;

at least some of the N, M, P and Q contact pins are arranged to make contact with respective contact pads of the first paddle-card;

the N and P contact pins are arranged to make contact with respective contact pads of the second paddle-card;

N, M, P, and Q are each greater than 10;

ten of the contact pins in the back row of the upper and lower surface and ten of the contract pins in the front row of the upper and lower surface are arranged to make contact with the respective contact pads of the SFP-DD form factor paddle-card; and eleven of the contact pins in the front row of the upper and lower surfaces are arranged to make contact with the respective contact pads of the DSFP form-factor paddle-card; and a plurality of termination legs electrically connected to the N, M, P and Q contact pins, and configured to be electromechanically connected to a printed circuit board.

24. The device according to claim 23, wherein a first outermost contact pin of the contacts pins in the front row of the upper surface, and a second outermost contact pin of the contact pins in the front row of the lower surface are arranged to make contact with only respective ones of the contact pads of the DSFP form-factor paddle card.

* * * * *